US009777912B2

(12) United States Patent
Tsai

(10) Patent No.: US 9,777,912 B2
(45) Date of Patent: Oct. 3, 2017

(54) LED LIGHT STRING MANUFACTURING METHOD AND LED LIGHT STRING

(71) Applicant: Chang-Fu Tsai, Taichung (TW)

(72) Inventor: Chang-Fu Tsai, Taichung (TW)

( * ) Notice: Subject to any disclaimer, the term of this patent is extended or adjusted under 35 U.S.C. 154(b) by 45 days.

(21) Appl. No.: 15/057,135

(22) Filed: Mar. 1, 2016

(65) Prior Publication Data

US 2017/0254523 A1 Sep. 7, 2017

(51) Int. Cl.

| | |
|---|---|
| ***F21V 15/00*** | (2015.01) |
| ***F21V 23/00*** | (2015.01) |
| ***F21V 19/00*** | (2006.01) |
| *F21Y 115/10* | (2016.01) |
| *F21S 4/10* | (2016.01) |

(52) U.S. Cl.

CPC ..... *F21V 23/002* (2013.01); *F21V 19/005* (2013.01); *F21V 19/0025* (2013.01); *F21S 4/10* (2016.01); *F21Y 2115/10* (2016.08)

(58) Field of Classification Search

CPC ..... F21Y 2115/10; F21Y 2101/00; F21S 4/10; F21S 4/20; F21S 4/26; F21S 4/00

USPC ..... 362/249.06, 800, 249.02, 227

See application file for complete search history.

(56) References Cited

U.S. PATENT DOCUMENTS 8,876,547 B1 * 11/2014 Tsai ..... H01R 13/504 29/872

* cited by examiner

*Primary Examiner* — Jamara Franklin

(74) *Attorney, Agent, or Firm* — Andrew C. Cheng

(57) ABSTRACT

Disclosed is an LED light string manufacturing method, as well as an LED light string manufactured with the method, which generally involves four components that are assembled through three operations or steps to allow for automatic mass production of LED light strings thereby saving material cost and increasing assembling efficiency. The four components include an upper housing member, a lower housing member, electrical wires, and an LED-based light emission element (with or without a cover). Two conductive pins of the LED-based light emission element are fixed to conductors of the electrical wires through welding and are then disposed between the upper and lower members of the housing, which are subjected to ultrasonic fusion for secured combination thereby covering and housing the electrical wires and the LED-based light emission element therein in one operation. The method is simple and very efficient so that the process is simplified and the cost reduced.

7 Claims, 7 Drawing Sheets

LED LIGHT STRING MANUFACTURING METHOD AND LED LIGHT STRING

BACKGROUND OF THE INVENTION

1. Field of the Invention

The present invention relates to a light-emitting diode (LED) light string manufacturing method and an LED light string manufactured with the method, and more particularly to efficient and automatic mass production for assembling an LED light string involving only four components with a process involving three operations.

2. The Related Arts

A conventional light string comprises, for the structure thereof, five major components including an LED light emission element (lighting bulb), a soft socket, a soft core, terminals, and electrical wires. The LED light emission element may additionally comprise a cover. As such, an assembly of the light string involves six components. In the known structure of light string, the electrical wires are generally in the form of two-in two-out. A manufacturing and assembling process of the known light string comprises, at least, the following steps or operations:

(1) The terminals are first cut and shaped, by means of proper processing machine, to be curved and attached to the electrical wires.

(2) A semi-product combination of the cut terminals and electrical wires are fit into and combined with the soft core.

(3) The cover is fit over and mounted to the soft core.

(4) Finally, the soft core and the soft socket are combined.

In the above assembly of the five or six components to make a light string, the number of the components is large and the entire manufacturing process is generally complicated.

Another light string is also available, comprising, for the structure thereof, an LED light emission element (lighting bulb), solder, adhesive, electrical wires, and plastic covering film, or additionally, a cover. For such a light string, a process of combining the LED light emission element (lighting bulb) and the electrical wires comprises, at least, the following steps or operations:

(1) The electrical wires are partly stripped to expose conductor cores.

(2) Two pins of the LED light emission element (lighting bulb) are respectively bonded to the exposed conductor cores of the electrical wires by means of the solder.

(3) The plastic covering film, which is generally thermoplastic, is wrapped around the soldering portion for an effect of additional fixing.

(4) A thermoplastic film is tightly wrapped around the combined portion of a lower portion of the LED light emission element (lighting bulb) and the electrical wires.

In the structure and assembly of the above light string, human labor is generally used for assembling, making it time-consuming and labor-consuming, and resulting in easy human errors in the assembly. As such, defect rate of the quality of the light string is high. The components used and the assembly process are both complicated, leading to additional increase of the parts cost and assembly operations, so that the manufacture management becomes complicated and the costs raised.

SUMMARY OF THE INVENTION

The primary object of the present invention is to provide a light-emitting diode (LED) light string manufacturing method, which involves only four components including: an upper housing member, a lower housing member, electrical wires, and an LED-based light emission element (with or without a cover), which can be assembled three operations or steps to allow for automatic mass production of LED light strings. The method comprises first fixing two conductive pins of the LED-based light emission element to conductors of the electrical wires through welding and then disposed between the upper and lower members of the housing that are subjected to ultrasonic fusion for secured combination thereby covering and housing the electrical wires and the LED-based light emission element in the interior thereof. This helps save material cost and increases assembling efficiency, and also avoids human errors occurring in a manual assembly process, thereby making the process simplified, the cost reduced, and yield rate increased.

A secondary object of the present invention is to provide an LED light string, which comprises four components, including an upper housing member, a lower housing member, electrical wires, and an LED-based light emission element, wherein two conductive pins of the LED-based light emission element are first fixed to the electrical wires through welding and they are then disposed between the upper and lower members of the housing, which are subjected to ultrasonic fusion for secured combination thereby simultaneously covering and housing the electrical wires and the LED-based light emission element in the interior of the housing through one operation. The entire structure is simplified, so that the assembly is easy, and is particularly fit to mass production of LED light strings through machinized automation.

BRIEF DESCRIPTION OF THE DRAWINGS

The present invention can be fully understood from the following detailed description and preferred embodiments with reference to the accompanying drawings, in which.

DETAILED DESCRIPTION OF THE PREFERRED EMBODIMENTS

Figure 1:
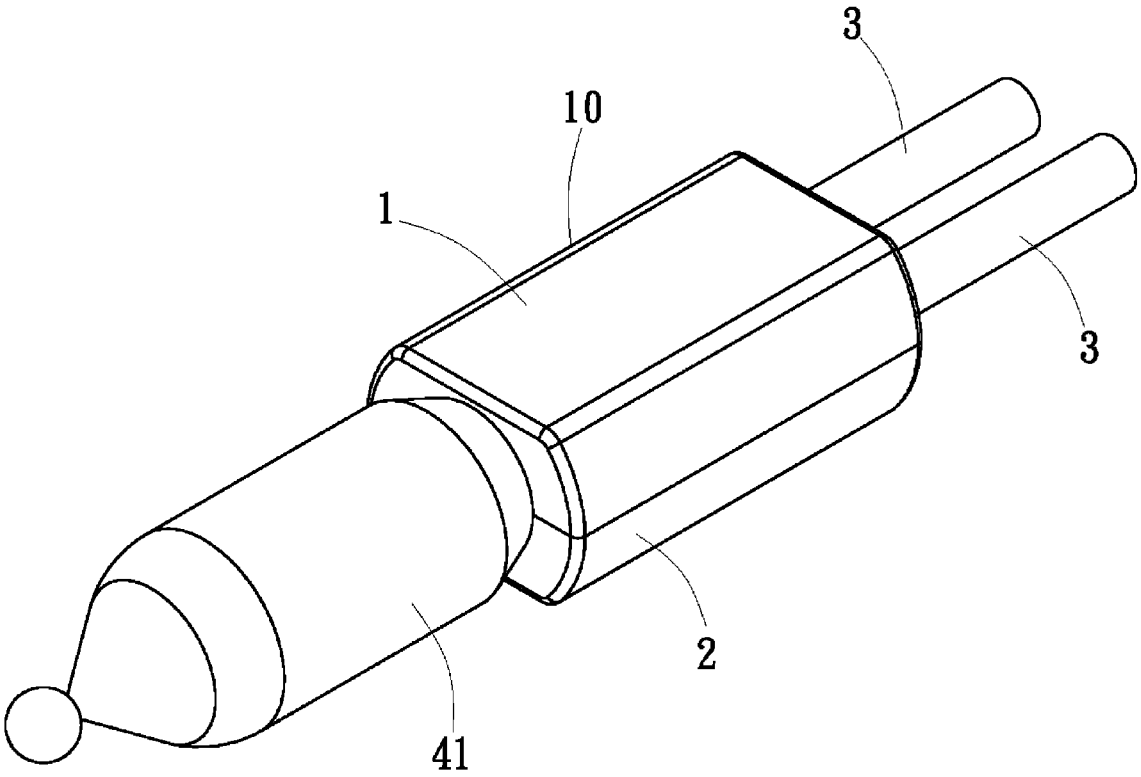
FIG. 1 is a perspective view showing the present disclosure in an assembled form.

To better expound the purposes, features, and effectiveness of the present invention to help better understand and appreciate the present invention, description will be given below with reference to embodiments and drawings of the present invention.

Figure 2:
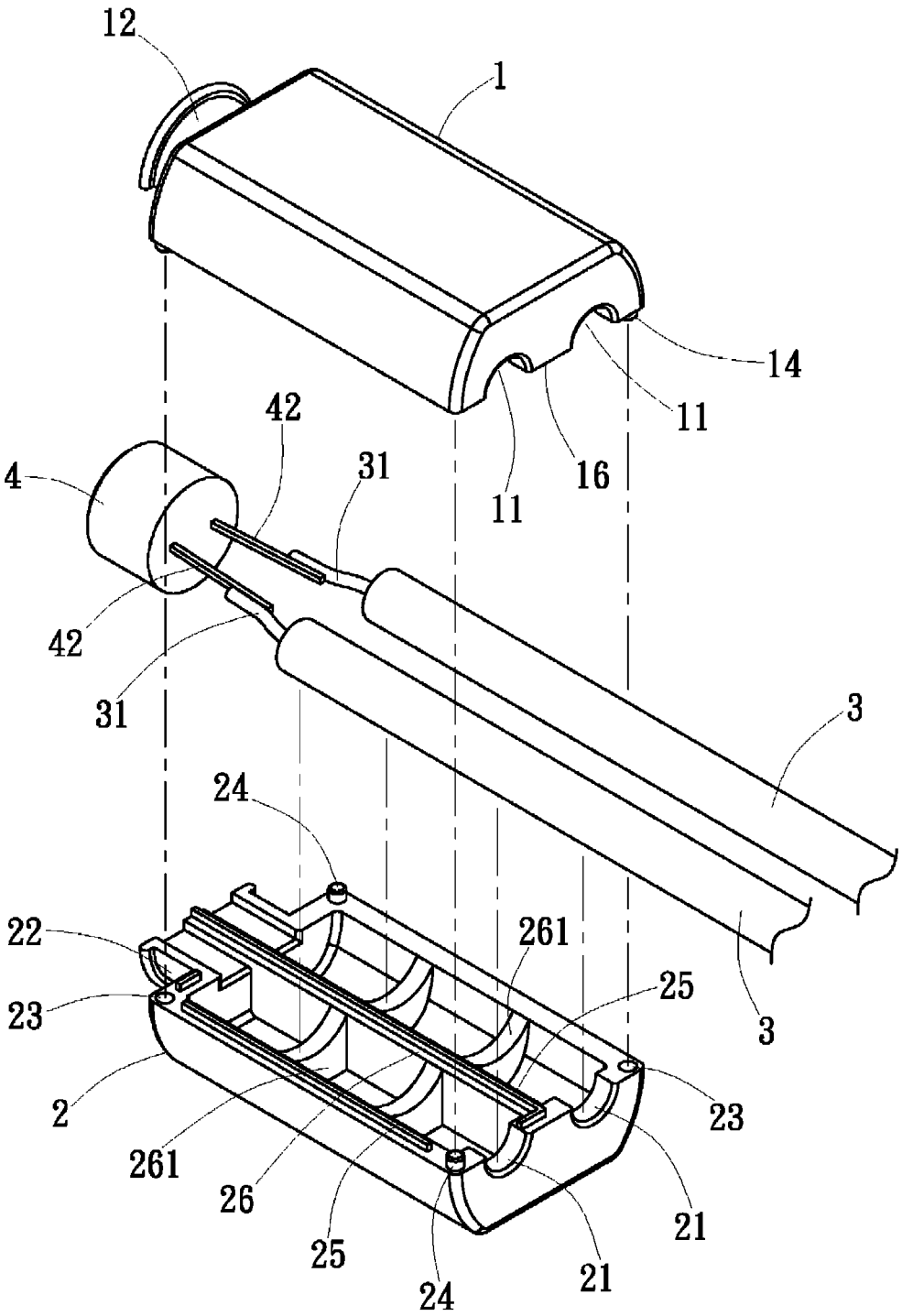
FIG. 2 is an exploded view of the present disclosure.

With reference to the embodiment illustrated in the drawings, the present invention provides a light-emitting diode (LED) light string manufacturing method, in which four components, including an upper housing member 1, a lower housing member 2, electrical wires 3, and a LED-based light emission element 4 (including or not including a cover 41), are involved and automatic mass production of the LED light string can be achieved with three steps or operations, which will be described as follows:

(1) As shown in FIG. 2, two conductive pins 42 of the light emission element 4 are first mounted to conductors 31 of electrical wires 3 by means of welding, wherein in such a welding operation, no solder or adhesive is needed, nor is a thermoplastic wrapping/covering film.

Figure 3:
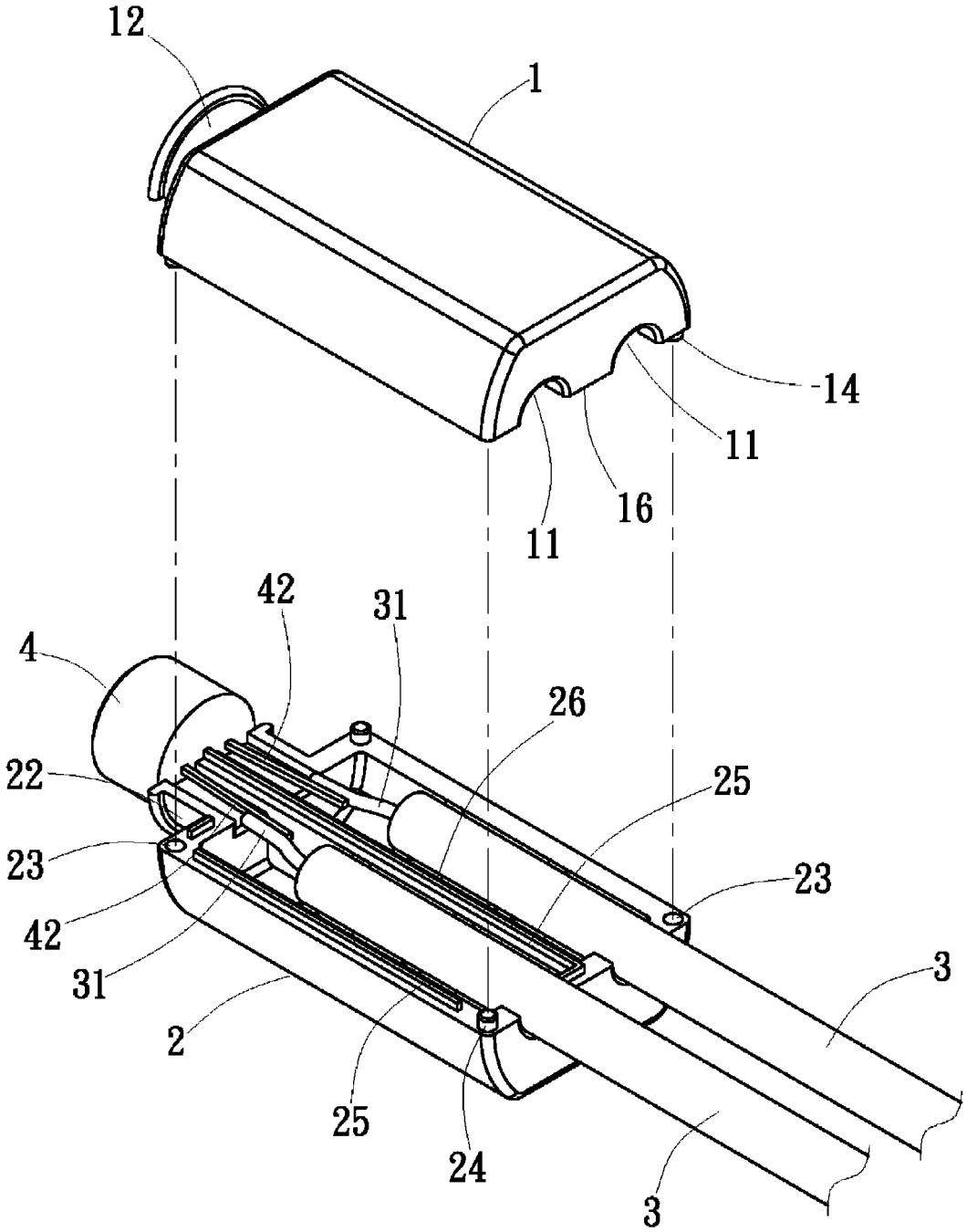
FIG. 3 is a schematic view showing a disposition and combination operation according to the present invention.
Figure 4:
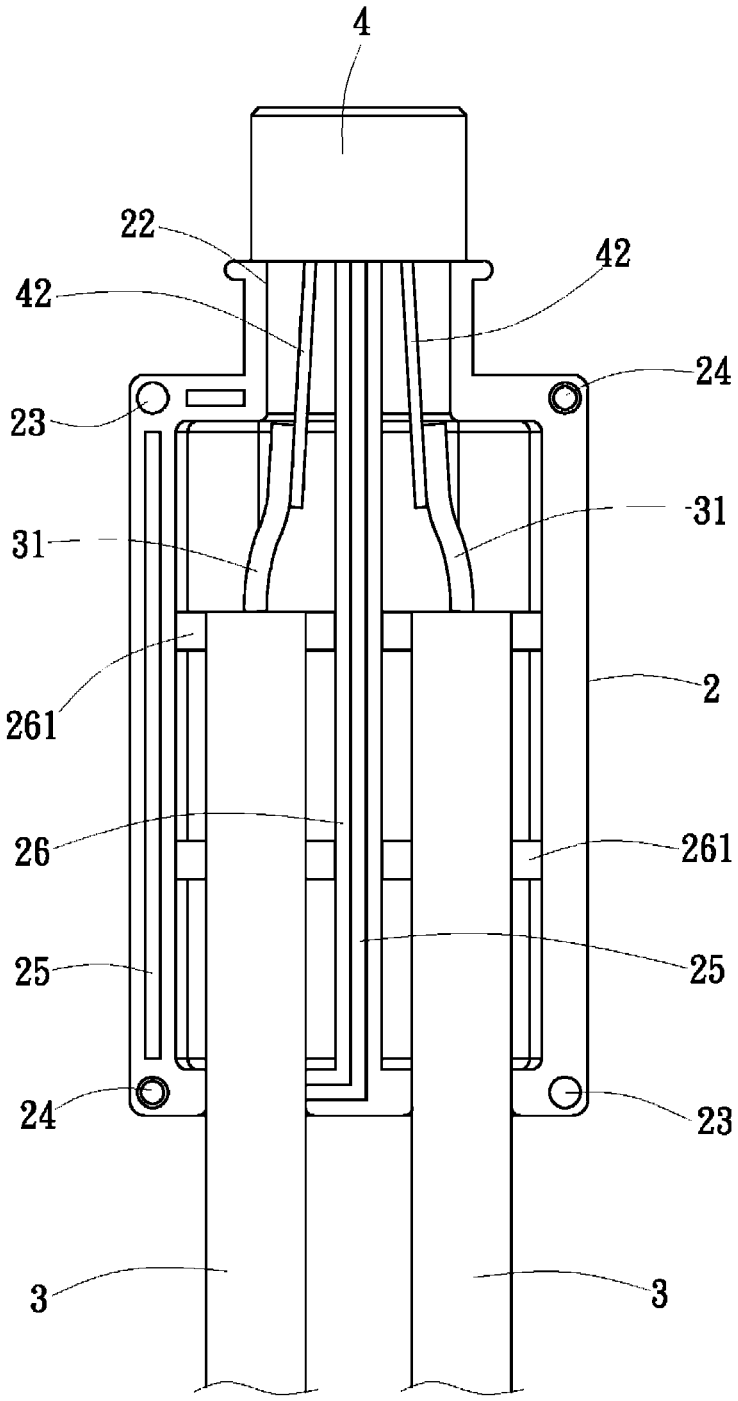
FIG. 4 is a top view showing the disposition and combination operation according to the present invention.
Figure 5:
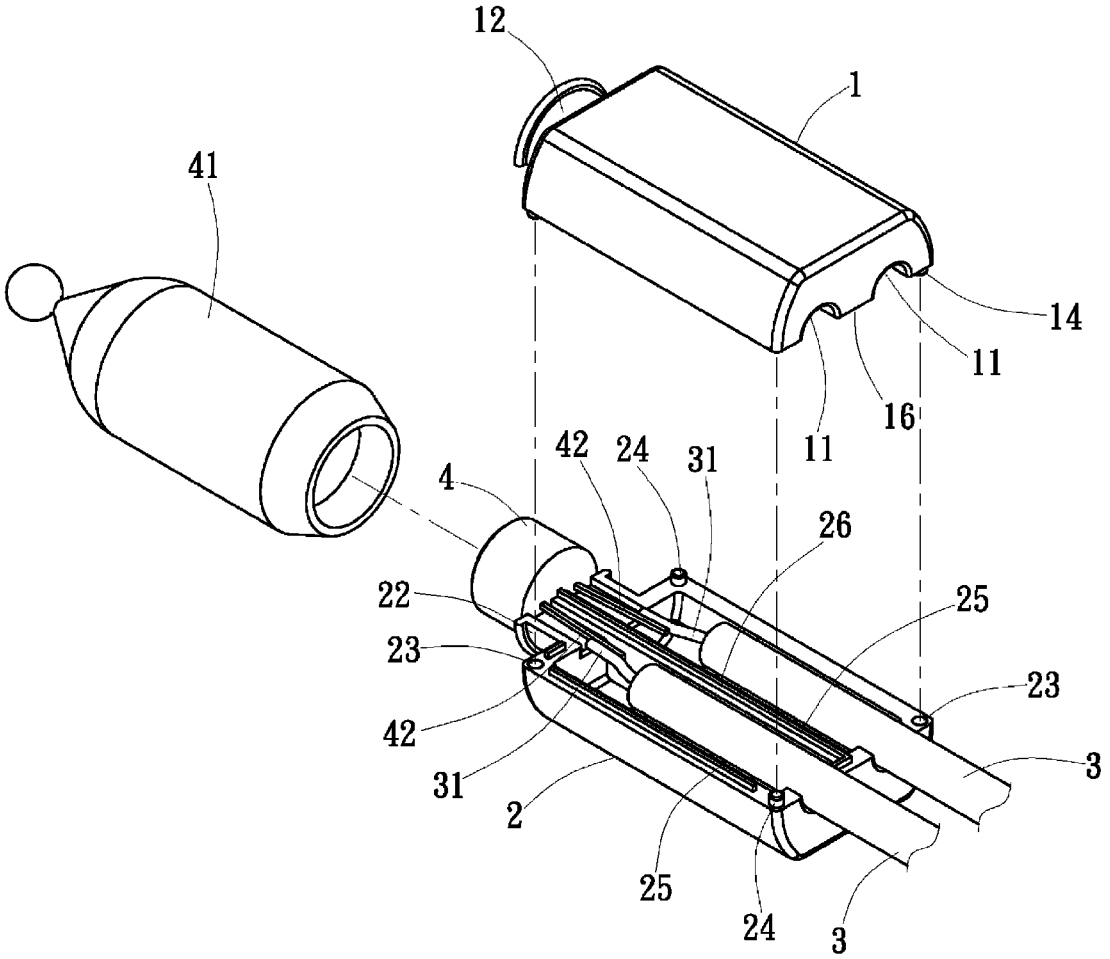
FIG. 5 is an exploded view showing an embodiment of the present invention that comprises a cover.

(2) As shown in FIGS. 3 and 5, the light emission element 4 and the electrical wires 3 that are welded together are disposed between the upper housing member 1 and the lower housing member 2.

(3) The upper housing member 1 and the lower housing member 2 are mated with and positioned on each other for closure and then securely combined together through ultrasonic fusion to have the electrical wires 3 and the light emission element 4 housed in and combined with housing 10 (as shown in FIG. 1), in an efficient and effective manner, thereby completing the assembly of the upper housing member 1, the lower housing member 2, the electrical wires 3, and the light emission element 4.

The upper housing member 1 may have any desired outside configuration, but comprises two recesses 11, preferably parallel to and separated from each other, for accommodating the conductors 31 of the electrical wires 3 and a joint section 12 that accommodates the two conductive pins 42 of the light emission element 4 therein.

Similarly, the lower housing member 2 may have any desired outside configuration, but also comprises two recesses 21, preferably parallel to and separated from each other and respectively corresponding to the recesses 11, for accommodating the conductors 31 of the electrical wires 3 and a joint section 22 that, preferably corresponding to the joint section 12, accommodates the two conductive pins 42 of the light emission element 4 therein. The lower housing member 2 and the upper housing member 1 may mate each other and be combined with each other to provide an effect of tight and secure closure.

The upper housing member 1 and the lower housing member 2 may have side walls that correspond to each other and are provided with one ore more fitting holes 23 and one or more fitting pillars 24 (14), which can mate each other by fitting to each other for temporarily holding the upper housing member 1 and the lower housing member 2 together when the upper and lower housing members are closed to each other in order to be in a jointed condition for subsequent ultrasonic fusion operation.

The upper housing member 1 and the lower housing member 2 may have side walls that mate each other and are provided thereon with one or more raised strips 25 and one or more recessed slot (not shown in the drawings), so that when the upper housing member 1 and the lower housing member 2 are combined together through ultrasonic fusion, the raised strip 25 and the corresponding recessed slot provide an effect of secure engagement so as to achieve more secured combination.

The upper housing member 1 and the lower housing member 2 may be provided in the interior thereof with insulation ribs 16, 26 corresponding to each other in order to separate the conductors 31 of the electrical wires 3 that are located on opposite sides thereof from each other to prevent shorting and also help improve the secured combination between the upper housing member 1 and the lower housing member 2 after the ultrasonic fusion of the upper housing member 1 and the lower housing member 2. Further, in addition to the insulation rib 26, the lower housing member 2 may be provided, in the interior thereof, with horizontal rib 261 that is arranged horizontal for connection with the insulation rib 26 to improve the structural strength of the lower housing member 2. This is also applicable to the upper housing member 1.

Figure 6:
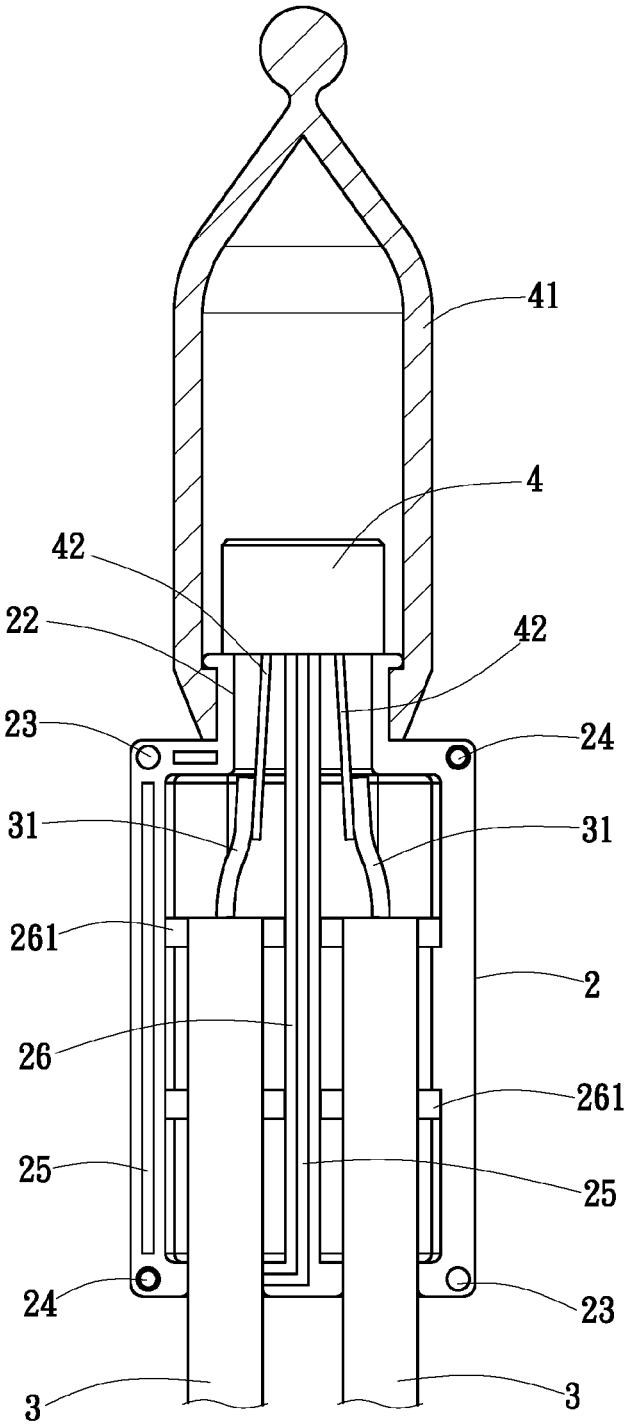
FIG. 6 is a schematic view showing a disposition and combination operation for the embodiment of FIG. 5 according to the present invention.

As shown in FIGS. 5 and 6, in an alternative form, the light emission element 4 can be a component that includes a cover 41 in such a way that the cover 41 is fit outside the light emission element 4 and an opening of the cover 41 is fit to and mate the joint sections 12, 22 of the upper housing member 1 and the lower housing member 2 that are combined together to be retained thereon.

Figure 7:
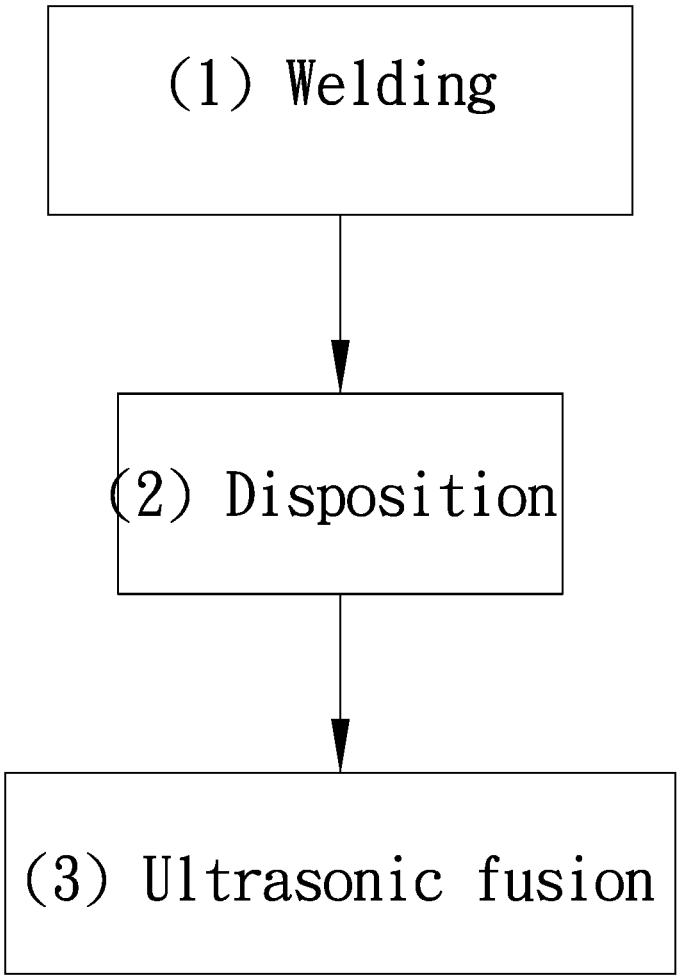
FIG. 7 is a flow chart illustrating a three-operation manufacturing process according to the present invention.

Further, as shown in FIG. 7, a manufacturing method involving three operations according to the present invention is illustrated, which comprises the following operations:

(1) Welding combination operation: two conductive pins 42 of an LED-based light emission element 4 and conductors 31 of electrical wires 3 are first fixed to each other through welding.

(2) Fast disposition operation: the light emission element 4 and the electrical wires 3 that are welded together are disposed, through a one-time and precise operation, between an upper housing member 1 and a lower housing member 2.

(3) Ultrasonic fusion operation: with the upper housing member 1 and the lower housing member 2 temporarily held together, ultrasonic fusion is applied to have them bonded together such that the upper housing member 1, the lower housing member 2, the electrical wires 3, and the light emission element 4 are efficiently combined together in a closed and housed configuration.

In summary, the present invention provides an LED light string manufacturing method and an LED light string manufactured with the method, which requires only four components and welding and ultrasonic fusion are adopted in the manufacturing method for bonding and combination to thereby simplify the manufacturing method and reduce the components used.

Illustrated above are the embodiments of the present disclosure, which should not be considered limitative to the scope of the invention. Therefore, any equivalent substitutions or variations to the structures or processes disclosed in the specification and the drawing of the present disclosure, or a direct or indirect application of the invention to the other technical fields should be considered as part of the present disclosure.

What is claimed is:

1. A light-emitting diode (LED) light string manufacturing method, which involves four components including an upper housing member, a lower housing member, electrical wires, and an LED-based light emission element and comprises three operations to achieve automatic mass production of LED light strings, the method comprising the following steps:

(1) fixing two conductive pins of the LED-based light emission element to conductors of the electrical wires through welding such that the conductive pins of the LED-based light emission element are respectively and fixedly attached to the conductors of the electrical wires, wherein the two conductive pins of the LED-based light emission element are arranged to extend in a predetermined direction away from the LED-based light emission element and the electrical wires are arranged substantially parallel to each other and collectively extend in the predetermined direction away from the LED-based light emission element such that the electrical wires are substantially parallel with the conductive pins of the LED-based light emission element;

(2) disposing the LED-based light emission element and the electrical wires that are welded together between the upper housing member and the lower housing member; and (3) positioning the upper housing member and the lower housing member on each other for closure and applying ultrasonic fusion thereto for combination so as to have the electrical wires and the LED-based light emission element housed and covered in an interior of a housing formed of the upper and lower housing members fused together to complete assembly of the upper housing member, the lower housing member, the electrical wires, and the LED-based light emission element;

wherein the upper and lower housing members that are combined with each other form a symmetric structure.

2. A light-emitting diode (LED) light string, comprising four components including: an upper housing member, a lower housing member, electrical wires, and an LED-based light emission element, wherein the upper housing member and the lower housing member are each provided with two recesses formed therein for accommodating the electrical wires and a joint section that accommodates conductive pins of the LED-based light emission element therein;

wherein the electrical wires comprise conductors;

wherein the LED-based light emission element comprises two conductive pins, which are fixed to the conductors of the electrical wires through welding and are disposed between the upper housing member and the lower housing member that are combined to each other through ultrasonic fusion so as to cover and house the electrical wires and the LED-based light emission element in an interior of a unitary combined housing structure formed of the upper and lower housing members fused together to complete assembly of the upper housing member, the lower housing member, the electrical wires, and the LED-based light emission element;

wherein the unitary combined housing structure formed by combining and fusing the upper and lower housing members together has a first end and a second end opposite to each other in a predetermined direction, wherein the recesses of the upper and lower housing members collectively define a plurality of channels extending in the predetermined direction from the second end of the unitary combined housing structure into the interior of the unitary combined housing structure, the electrical wires being respectively accommodated in the channels and collectively extending the predetermined direction along the channels in a manner of being substantially parallel to each other, and wherein the joint sections of the upper and lower housing members collectively define two passages extending in the predetermined direction from the first end of the unitary combined housing structure into the interior of the unitary combined housing structure, wherein the two conductive pins of the LED-based light emission element are respectively accommodated in the passages and collectively extending in the predetermined direction in a manner of being substantially parallel to each other and also substantially parallel to the electrical wires; and wherein the unitary combined housing structure has a symmetric structure.

3. The LED light string as claimed in claim 2, wherein the upper housing member and the lower housing member have side walls on which a fitting hole and a fitting pillar are formed for fitting to and combinable with each other.

4. The LED light string as claimed in claim 2, wherein the upper housing member and the lower housing member have side walls on which a raised strip and a recessed slot are formed for mating and combination with each other.

5. The LED light string as claimed in claim 2, wherein the upper housing member and the lower housing member each have an interior space in which an insulation rib is formed to correspond to each other for separating the conductors of the electrical wires from each other.

6. The LED light string as claimed in claim 5, wherein the upper housing member and the lower housing member are each provided, in the interior space thereof, with a horizontal rib connected with the insulation rib.

7. The LED light string as claimed in claim 2, wherein the LED-based light emission element comprises a cover, which is fit outside the LED-based light emission element and has an opening that mates with and is fit to the joint sections of the upper housing member and the lower housing member.

* * * * *